US005408825A

United States Patent [19]

Foss et al.

[11] Patent Number: 5,408,825

[45] Date of Patent: Apr. 25, 1995

[54] DUAL FUEL GAS TURBINE COMBUSTOR

[75] Inventors: David T. Foss, Winter Park; Diane M. Marshall, Casselberry, both of Fla.

[73] Assignee: Westinghouse Electric Corporation, Pittsburgh, Pa.

[21] Appl. No.: 161,023

[22] Filed: Dec. 3, 1993

[51] Int. Cl.[6] ..... F02C 3/20; F23R 3/32

[52] U.S. Cl. ..... 60/39.463; 60/733; 60/737; 60/742

[58] Field of Search ..... 60/39.463, 733, 737, 60/742, 746, 734, 740, 748, 760, 736; 431/284, 285; 239/427.3, 427.5

[56] References Cited

U.S. PATENT DOCUMENTS

| | | | |
|---|---|---|---|
| 1,828,784 | 10/1931 | Perrin | 60/736 |
| 2,621,477 | 12/1952 | Powter et al. | 60/737 |
| 2,635,426 | 4/1953 | Meschino | 60/737 |
| 2,720,081 | 10/1955 | Tutherly | 60/760 |
| 4,062,182 | 12/1977 | Fehler et al. | 60/737 |
| 4,112,676 | 9/1978 | Decorso | 60/737 |
| 4,133,633 | 1/1979 | Fehler et al. | 60/740 |
| 4,240,784 | 12/1980 | Dauvergne | 239/427.3 |
| 4,610,135 | 9/1986 | Alexander | 60/746 |
| 4,735,052 | 4/1988 | Maeda et al. | 60/746 |
| 4,977,740 | 12/1990 | Madden et al. | 60/39.463 |
| 5,016,443 | 5/1991 | Shimizu et al. | 60/737 |
| 5,085,575 | 2/1992 | Keller et al. | 431/284 |
| 5,177,955 | 1/1993 | Shekleton | 60/746 |
| 5,203,692 | 4/1993 | Wexoe | 431/284 |
| 5,259,184 | 11/1993 | Borkowicz et al. | 60/742 |
| 5,295,352 | 3/1994 | Beebe et al. | 60/737 |
| 5,319,935 | 6/1994 | Toon et al. | 601/748 |

FOREIGN PATENT DOCUMENTS

| | | | |
|---|---|---|---|
| 0183720 | 7/1990 | Japan | 60/737 |

OTHER PUBLICATIONS

Willis et al., "Industrial RB211 Dry Low Emission Combustion", ASME Journal, pp. 1–7 (May 1993).

*Primary Examiner*—Timothy S. Thorpe
*Attorney, Agent, or Firm*—G. R. Jarosik

[57] ABSTRACT

A combustor for a gas turbine having primary and secondary combustion zones. The combustor has a centrally disposed dual fuel nozzle that can supply a fuel rich mixture of either liquid and gaseous fuel to the primary combustion zone. The combustor also has primary gas fuel spray bars for supplying a lean mixture of gaseous fuel to the primary combustion zone via a first annular pre-mixing passage and secondary gas fuel spray bars for supplying a lean mixture of gaseous fuel to the secondary combustion zone via a second annular pre-mixing passage. In addition, the combustor also has a plurality of liquid fuel spray nozzles for introducing a lean mixture of liquid fuel into the secondary combustion zone via the second annular pre-mixing passage. The liquid fuel spray nozzles are disposed in fan shaped channels that are arranged in a circumferential array and that are connected to the second annular pre-mixing passage. The fan shaped channels cause expansion of the spray of fuel from the liquid spray nozzles and serve to ensure good atomization of the liquid fuel prior to its introduction into the second annular pre-mixing passage.

15 Claims, 3 Drawing Sheets

DUAL FUEL GAS TURBINE COMBUSTOR

BACKGROUND OF THE INVENTION

The present invention relates to a gas turbine combustor for burning both liquid and gaseous fuel in compressed air. More specifically, the present invention relates to a low NOx combustor having the capability of burning lean mixtures of both liquid and gaseous fuel.

In a gas turbine, fuel is burned in compressed air, produced by a compressor, in one or more combustors. Traditionally, such combustors had a primary combustion zone in which an approximately stoichiometric mixture of fuel and air was formed and burned in a diffusion type combustion process. Fuel was introduced into the primary combustion zone by means of a centrally disposed fuel nozzle. When operating on liquid fuel, such nozzles were capable of spraying fuel into the combustion air so that the fuel was atomized before it entered the primary combustion zone. Additional air was introduced into the combustor downstream of the primary combustion zone so that the overall fuel/air ratio was considerably less than stoichiometric—i.e., lean. Nevertheless, despite the use of lean fuel/air ratios, the fuel/air mixture was readily ignited at start-up and good flame stability was achieved over a wide range of firing temperatures due to the locally richer nature of the fuel/air mixture in the primary combustion zone.

Unfortunately, use of rich fuel/air mixtures in the primary combustion zone resulted in very high temperatures. Such high temperatures promoted the formation of oxides of nitrogen ("NOx"), considered an atmospheric pollutant. It is known that combustion at lean fuel/air ratios reduces NOx formation. However, achieving such lean mixtures requires that the fuel be widely distributed and very well mixed into the combustion air. This can be accomplished by pre-mixing the fuel into the combustion air prior to its introduction into the combustion zone.

In the case of gaseous fuel, this pre-mixing can be accomplished by introducing the fuel into primary and secondary annular passages that pre-mix the fuel and air and then direct the pre-mixed fuel into primary and secondary combustion zones, respectively. The gaseous fuel is introduced into these primary and secondary pre-mixing passages using fuel spray tubes distributed around the circumference of each passage. A combustor of this type is disclosed in "Industrial RB211 Dry Low Emission Combustion" by J. Willis et al., American Society of Mechanical Engineers (May 1993).

Unfortunately, such combustors are capable of operation on only gaseous fuel because the fuel spray tubes are not adapted to atomize liquid fuel into the combustor. Liquid fuel spray nozzles, such as those used in conventional rich-burning combustors, are known. However, sufficient mixing of the fuel and air to achieve adequately lean fuel/air ratios can not be achieved by merely incorporating such a nozzle into the pre-mixing passage. This is so because such liquid fuel spray nozzles do not completely atomize the fuel, resulting in the formation of large fuel droplets and locally rich fuel/air mixtures.

It is therefore desirable to provide a gas turbine combustor having primary and secondary passages for pre-mixing gaseous fuel in combustion air that is also capable of pre-mixing a liquid fuel in at least one of the gas pre-mixing passages.

SUMMARY OF THE INVENTION

Accordingly, it is the general object of the current invention to provide a gas turbine combustor having primary and secondary passages for pre-mixing gaseous fuel in combustion air that is capable of pre-mixing a liquid fuel in at least one of the gas pre-mixing passages.

Briefly, this object, as well as other objects of the current invention, is accomplished in a gas turbine comprising a compressor section for producing compressed air and a combustor for heating the compressed air. The combustor has a primary combustion zone and first and second concentrically arranged cylindrical liners encircling the primary combustion zone. The first liner encloses the second liner and forms an annular passage therebetween that is in flow communication with the compressor section so that the compressed air flows through the annular passage. The combustor also has first and second fuel introducing means. The first fuel introducing means introduces a gaseous fuel into the annular passage, whereby the gaseous fuel mixes with the compressed air flowing through the annual passage. The second fuel introducing means introduces a liquid fuel into the annular passage, whereby the liquid fuel mixes with the compressed air flowing through the annual passage.

In the preferred embodiment of the invention, the second fuel introducing means comprises (i) means for discharging the liquid fuel in a spray and (ii) means for expanding the liquid fuel spray prior to the introduction of the liquid fuel into the annular passage. The spray expanding means comprises an expanding channel having a first portion in which the liquid fuel spray discharging means is disposed and a second portion connected to the annular passage.

DESCRIPTION OF THE PREFERRED EMBODIMENT

Figure 1:
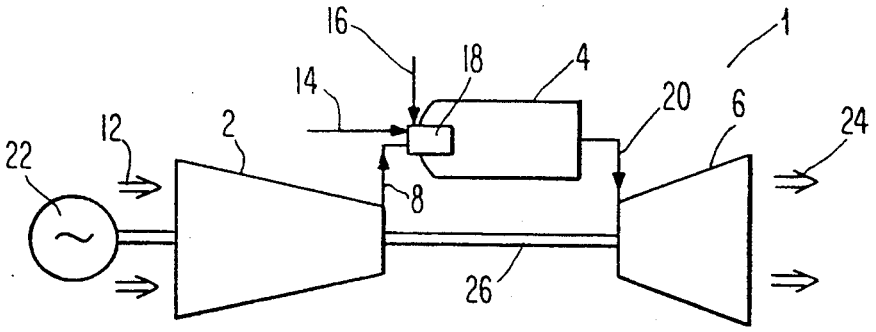
FIG. 1 is a schematic diagram of a gas turbine employing the combustor of the current invention.

Referring to the drawings, there is shown in FIG. 1 a schematic diagram of a gas turbine 1. The gas turbine 1 is comprised of a compressor 2 that is driven by a turbine 6 via a shaft 26. Ambient air 12 is drawn into the compressor 2 and compressed. The compressed air 8 produced by the compressor 2 is directed to a combustion system that includes one or more combustors 4 and a fuel nozzle 18 that introduces both gaseous fuel 16 and oil fuel 14 into the combustor. As is conventional, the gaseous fuel 16 may be natural gas and the liquid fuel 14 may be no. 2 diesel oil, although other gaseous or liquid fuels could also be utilized. In the combustors 4, the fuel is burned in the compressed air 8, thereby producing a hot compressed gas 20.

The hot compressed gas 20 produced by the combustor 4 is directed to the turbine 6 where it is expanded, thereby producing shaft horsepower for driving the compressor 2, as well as a load, such as an electric generator 22. The expanded gas 24 produced by the turbine 6 is exhausted, either directly to the atmosphere or, in a combined cycle plant, to a heat recovery steam generator and then to atmosphere.

Figure 2:
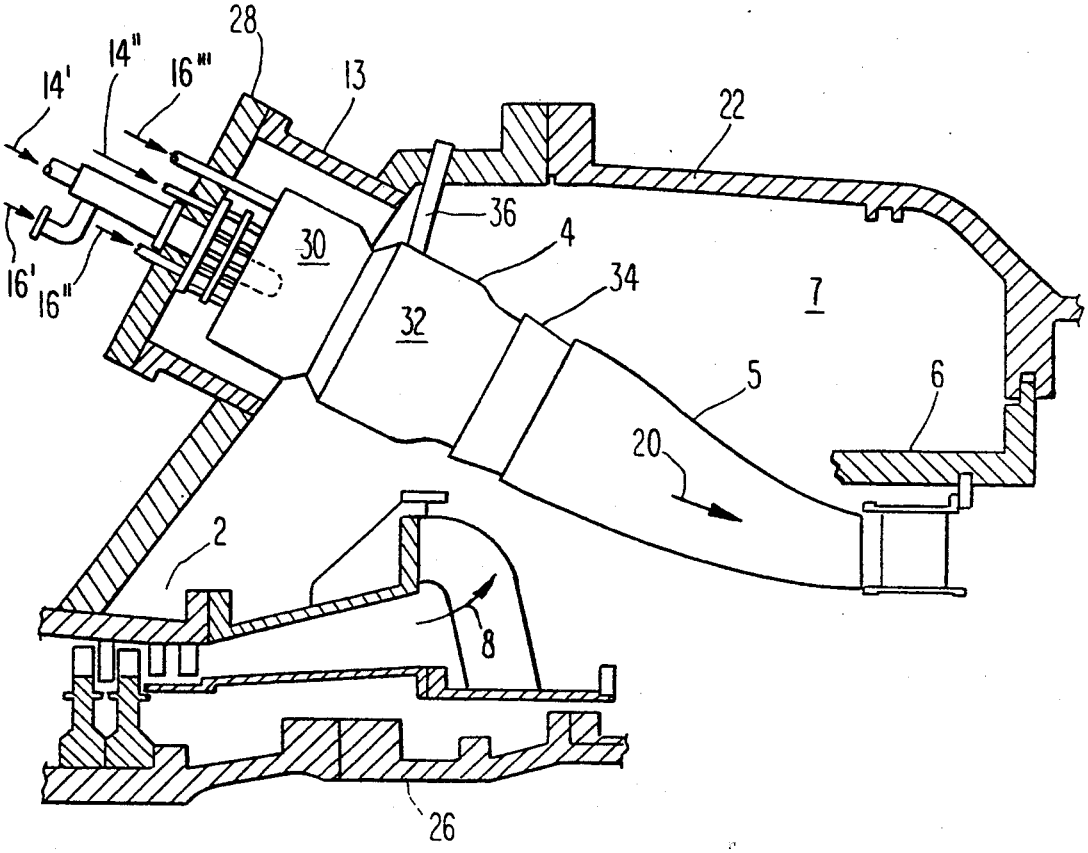
FIG. 2 is a longitudinal cross-section through the combustion section of the gas turbine shown in FIG. 1.

FIG. 2 shows the combustion section of the gas turbine 1. A circumferential array of combustors 4, only one of which is shown, are connected by cross-flame tubes 82, shown in FIG. 3, and disposed in a chamber 7 formed by a shell 22. Each combustor has a primary section 30 and a secondary section 32. The hot gas 20 exiting from the secondary section 32 is directed by a duct 5 to the turbine section 6. The primary section 30 of the combustor 4 is supported by a support plate 28. The support plate 28 is attached to a cylinder 13 that extends from the shell 22 and encloses the primary section 30. The secondary section 32 is supported by eight arms (not shown) extending from the support plate 28. Separately supporting the primary and second sections 30 and 32, respectively, reduces thermal stresses due to differential thermal expansion.

Figure 3:
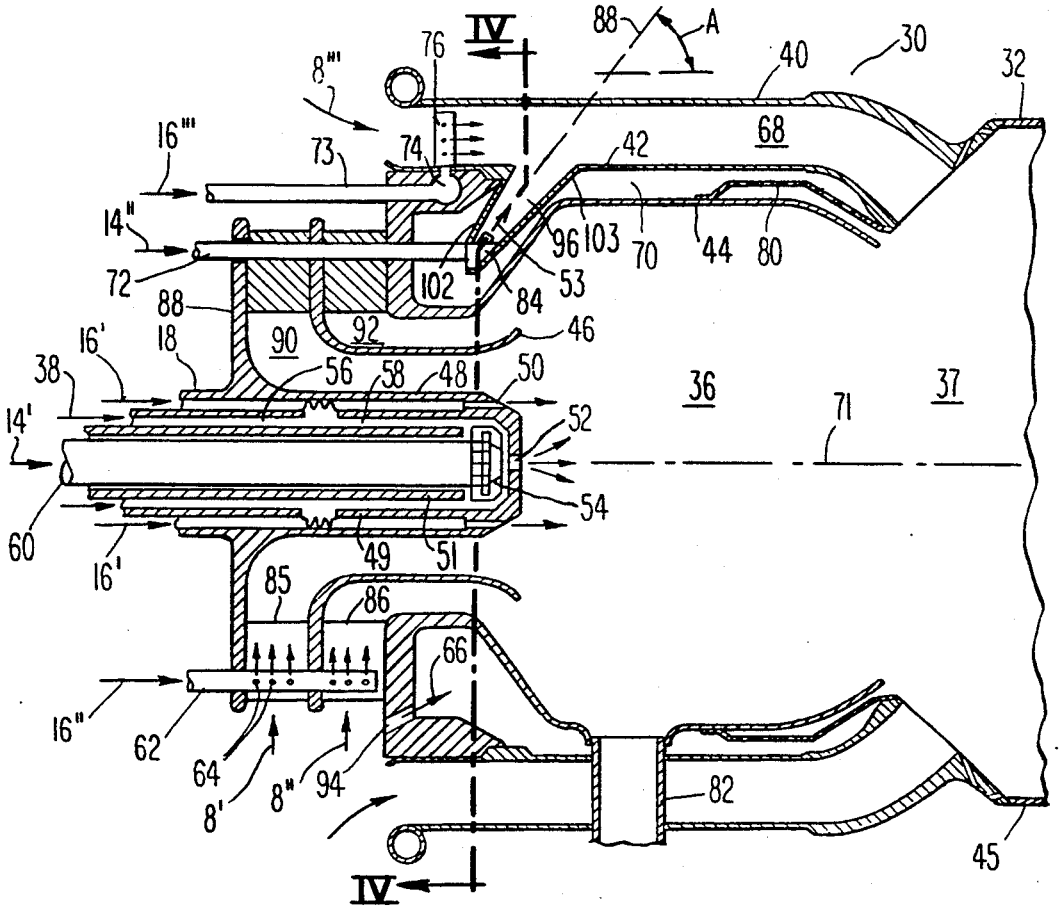
FIG. 3 is a longitudinal cross-section through the combustor shown in FIG. 2, with the cross-section taken through lines III—III shown in FIG. 4.

The combustor 4 has a combustion zone having primary and secondary portions. Referring to FIG. 3, the primary combustion zone portion 36 of the combustion zone, in which a lean mixture of fuel and air is burned, is located within the primary section 30 of the combustor 4. Specifically, the primary combustion zone 36 is enclosed by a cylindrical inner liner 44 portion of the primary section 30. The inner liner 44 is encircled by a cylindrical middle liner 42 that is, in turn, encircled by a cylindrical outer liner 40. The liners 40, 42 and 44 are concentrically arranged around an axial center line 71 so that an inner annular passage 70 is formed between the inner and middle liners 44 and 42, respectively, and an outer annular passage 68 is formed between the middle and outer liners 42 and 44, respectively. Cross-flame tubes 82, one of which is shown in FIG. 3, extend through the liners 40, 42 and 44 and connect the primary combustion zones 36 of adjacent combustors 4 to facilitate ignition.

As shown in FIG. 3, according to the current invention, a dual fuel nozzle 18 is centrally disposed within the primary section 30. The fuel nozzle 18 is comprised of a cylindrical outer sleeve 48, which forms an outer annular passage 56 with a cylindrical middle sleeve 49, and a cylindrical inner sleeve 51, which forms an inner annular passage 58 with the middle sleeve 49. An oil fuel supply tube 60 is disposed within the inner sleeve 51 and supplies oil fuel 14' to an oil fuel spray nozzle 54. The oil fuel 14' from the spray nozzle 54 enters the primary combustion zone 36 via an oil fuel discharge port 52 formed in the outer sleeve 48. Gas fuel 16' flows through the outer annular passage 56 and is discharged into the primary combustion zone 36 via a plurality of gas fuel ports 50 formed in the outer sleeve 48. In addition, cooling air 38 flows through the inner annular passage 58.

Pre-mixing of gaseous fuel 16'' and compressed air from the compressor 2 is accomplished for the primary combustion zone 36 by a primary pre-mixing passage formed in the front end of the primary section 30. As shown in FIG. 3, the primary pre-mixing passage is formed by first and second passages 90 and 92 that divide the incoming air into two streams 8' and 8''. The first passage 90 has an upstream radial portion and a downstream axial portion. The upstream portion of the first passage 90 is formed between a radially extending circular flange 88 and the radially extending portion of a flow guide 46. The downstream portion is formed between the flow guide 46 and the outer sleeve 48 of the fuel nozzle 18 and is encircled by the second passage 92.

The second passage 92 also has an upstream radial portion and a downstream axial portion. The upstream portion of second passage 92 is formed between the radially extending portion of the flow guide 46 and a radially extending portion of the inner liner 44. The downstream portion of second passage 92 is formed between the axial portion of the flow guide 46 and an axially extending portion of the inner liner 44 and is encircled by the upstream portion of the passage 92. As shown in FIG. 3, the upstream portion of the second passage 92 is disposed axially downstream from the upstream portion of first passage 90 and the downstream portion of second passage 92 encircles the downstream portion of the first passage 90.

Figure 4:
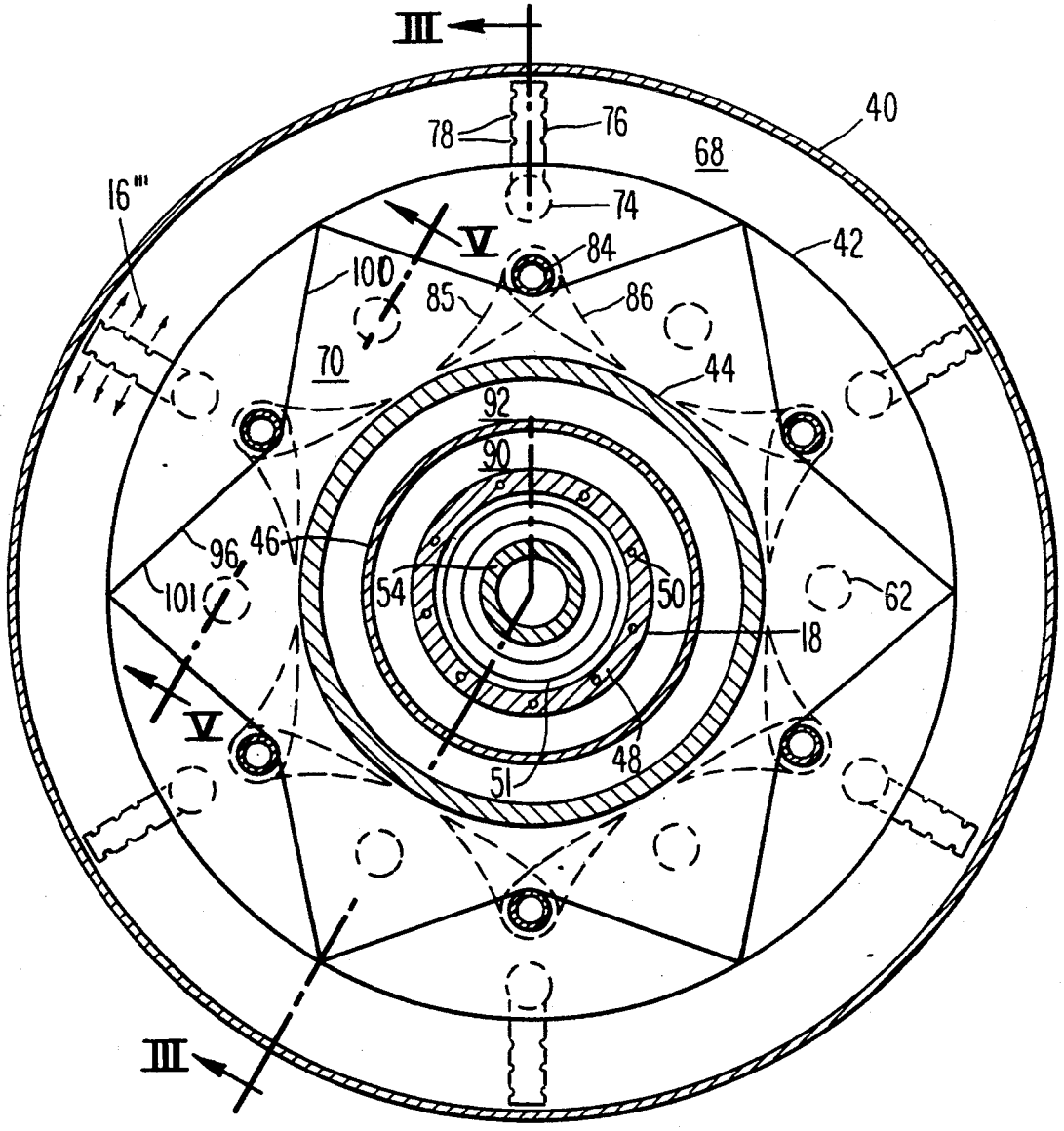
FIG. 4 is a transverse cross-section taken through lines IV—IV shown in FIG. 3.

As shown in FIGS. 3 and 4, a number of axially oriented, tubular primary fuel spray pegs 62 are distributed around the circumference of the primary pre-mixing passage so as to extend through the upstream portions of the both the first and second passages 90 and 92. Two rows of gas fuel discharge ports 64, one of which is shown in FIG. 3, are distributed along the length of each of the primary fuel pegs 62 so as to direct gas fuel 16'' into the air steams 8' and 8'' flowing through the passages 90 and 92. The gas fuel discharge ports 64 are oriented so as to discharge the gas fuel 16'' circumferentially in the clockwise and counterclockwise directions.

As also shown in FIGS. 3 and 4, a number of swirl vanes 85 and 86 are distributed around the circumference of the upstream portions of the passages 90 and 92. In the preferred embodiment, a swirl vane is disposed between each of the primary fuel pegs 62. As shown in FIG. 4, the swirl vanes 85 impart a counterclockwise (when viewed in the direction of the axial flow) rotation to the air stream 8', while the swirl vanes 86 impart a clockwise rotation to the air stream 8''. The swirl imparted by the vanes 85 and 86 to the air streams 8' and 8'' helps ensure good mixing between the gas fuel 16'' and the air, thereby eliminating locally fuel rich mixtures and the associated high temperatures that increase NOx generation.

As shown in FIG. 3, the secondary combustion zone portion 37 of the combustion zone is formed within a liner 45 in the secondary section 32 of the combustor 2. The outer annular passage 68 discharges into the secondary combustion zone 37 and, according to the current invention, forms both a liquid and gaseous fuel pre-mixing passage for the secondary combustion zone. The passage 68 defines a center line that is coincident with the axial center line 71. A portion 8''' of the compressed air 8 from the compressor section 2 flows into the passage 68.

A number of radially oriented secondary gas fuel spray pegs 76 are circumferentially distributed around the secondary pre-mixing passage 68. The secondary gas fuel pegs 76 are supplied with fuel 16''' from a circumferentially extending manifold 74. Axially extending fuel supply tubes 73 direct the fuel 16''' to the manifold 74. Two rows of gas fuel discharge ports 78 are distributed along the length of each of the secondary fuel pegs 76 so as to direct gas fuel 16''' into the secondary air steam 8''' flowing through the secondary pre-mixing passage 68. As shown best in FIG. 4, the gas fuel discharge ports 78 are oriented so as to discharge the gas fuel 16''' circumferentially in both the clockwise and counterclockwise directions.

According to the current invention, the secondary pre-mixing passage 68 is also utilized to provide pre-mixing of liquid fuel 14'' and the compressed air 8'''. As shown in FIGS. 3 and 4, this pre-mixing is accomplished by six liquid fuel spray nozzles 84 that are circumferentially arranged around the center line 71, although a greater or lesser number of liquid fuel spray nozzles could also be utilized. Each spray nozzle 84 is supplied with liquid fuel 14'' by an axially extending fuel tube 72 that can also be utilized to support the swirl vanes 85 and 86, as shown in FIGS. 3 and 4.

Figure 5:
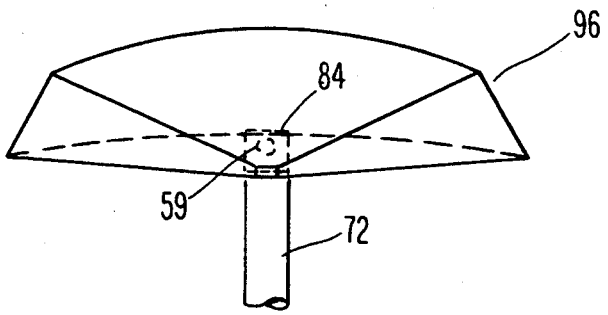
FIG. 5 is a view of the fan shaped channel and fuel spray nozzle shown in FIGS. 3 and 4 taken along line V—V shown in FIG. 4.

In the preferred embodiment, each of the spray nozzles 84 has an orifice 59, shown in FIG. 5, that causes it to discharge a flat spray 53 of liquid fuel 14''. Such nozzles are available from Parker-Hannifin of Andover, Ohio. The spraying of the liquid fuel 14'' in this fashion creates a certain degree of atomization that aids in the mixing of the fuel and air. As shown in FIG. 3, in order to promote further mixing of the liquid fuel 14'' and air 8''', the spray nozzles 84 are oriented so that the fuel spray 53 is directed into the secondary pre-mixing passage 68 along a line 88 disposed at an angle A to the center line 71 of the passage—that is, at an angle A to the direction of flow of the compressed air 8'''. In the preferred embodiment, the angle A is approximately 60°.

Figure 6:
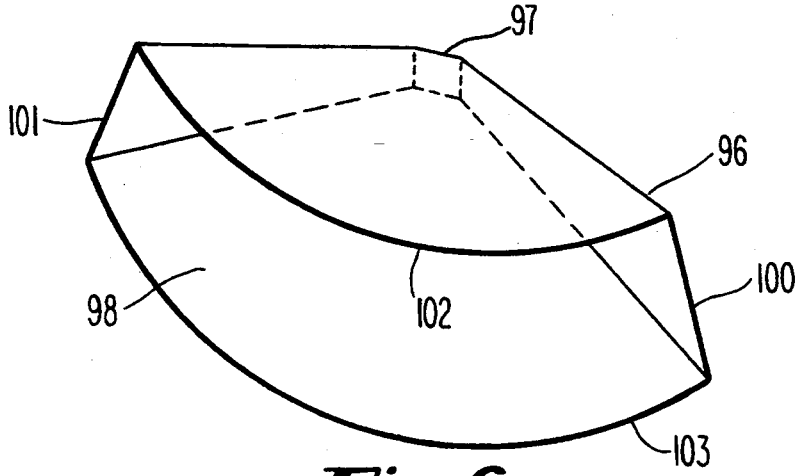
FIG. 6 is an isometric view of the fan shaped channel shown in FIG. 5.

According to an important aspect of the current invention, the liquid fuel spray nozzles 84 are located in fan shaped channels 96, shown best in FIGS. 5 and 6. The six channels 96 are disposed in a circumferential array around the center line 71. In addition, the channels 96 extend in the radially outward and axially downstream directions so that, like the liquid fuel spray 53, they are oriented at the angle A to the center line 71.

As shown in FIG. 6, the channels 96 are formed by side walls 100 and 101, as well as front and rear walls 102 and 103. The four walls of each channel 96 converge at a portion 97 of the channel hereinafter referred to as its "apex." An outlet 98 is formed opposite to the apex 97 and connects with the secondary annular passage 68, as shown in FIG. 3. Returning to FIG. 6, the side walls 100 and 101 are disposed at an oblique angle to each other so that the channel expands in the circumferential direction from the apex 97 to the outlet 98. In addition, the front and rear walls 102 and 103, respectively, are oriented at an acute angle to each other so that the channel also expands in the axial direction from the apex 97 to the outlet 98. Thus, in the preferred embodiment of the invention, the channels 96 expand in two directions from the apex 97 to the outlet 96.

Each liquid spray nozzle 84 is disposed within the apex portion 97 of its channel 96 and is oriented so as direct the fuel spray 53 toward the channel outlet 98. As a result of the expansion in the flow area of the channel 96 from the apex 97 to the outlet 98, the liquid fuel spray 53 undergoes an expansion as well on its way toward the secondary pre-mixing passage 68. This expansion helps to further atomize the liquid fuel 14'' into the combustion air 8'''. As a result of this expansion, in conjunction with the circumferential arrangement of spray nozzles 84, the liquid fuel 14'' is introduced into the secondary pre-mixing passage 68 in a well atomized form that is relatively uniformly distributed about the circumference of the passage. The length of the secondary pre-mixing passage 68, allows the atomized fuel 14'' and air 8''' to become well mixed within the passage so that a lean fuel/air ratio is created in the secondary combustion zone 37, thereby minimizing the formation of NOx.

During gas fuel operation, a flame is initially established in the primary combustion zone 36 by the introduction of gas fuel 16' via the central fuel nozzle 18. As increasing load on the turbine 6 requires higher firing temperatures, additional fuel is added by introducing gas fuel 16'' via the primary fuel pegs 62. Since the primary fuel pegs 62 result in a much better distribution of the fuel within the air, they produce a leaner fuel/air mixture than the central nozzle 18 and hence lower NOx. Thus, once ignition is established in the primary combustion zone 36, the fuel to the central nozzle 18 can be shut-off. Further demand for fuel flow beyond that supplied by the primary fuel pegs 62 can then be satisfied by supplying additional fuel 16''' via the secondary fuel pegs 76.

During liquid fuel operation, a flame is initially established in the primary combustion zone 36 by the introduction of liquid fuel 14' via the central fuel nozzle 18, as in the case of gaseous fuel operation. Additional fuel is added by introducing liquid fuel 14'' into the secondary combustion zone 37 via the secondary pre-mixing passage 68. Since the use of the distributed fuel spray nozzles 84 and the fan shaped channels 96 results in a much better distribution of the fuel within the air than does the central nozzle 18, the combustion of the liquid fuel 14'' introduced through the secondary pre-mixing passage 68 produces a leaner fuel/air mixture and hence lower NOx than the combustion of the fuel 14' through the central nozzle 18. Thus, once ignition is established in the primary combustion zone 36, the fuel 14' to the central nozzle 18 need not be increased further since the demand for additional fuel flow can be satisfied by supplying fuel 14'' to the spray nozzles 84.

Since the liquid fuel spray nozzles 84 are in relatively close proximity to the primary combustion zone 36, it is important to cool the nozzles to prevent coking of the liquid fuel 14''. According to the current invention, this is accomplished by forming a number of holes 94 in the radially extending portion of the inner liner 44, as shown in FIG. 3. These holes 94 allow a portion 66 of the compressed air 8 from the compressor section 2 to enter the annular passage 70 formed between the inner liner 44 and the middle liner 42.

An approximately cylindrical baffle 80 is located at the outlet of the passage 70 and extends between the inner liner 44 and the middle liner 42. A number of holes are distributed around the circumference of the baffle 80 and divide the cooling air 66 into a number of jets that impinge on the outer surface of the inner liner 44, thereby cooling it. Thus, the air 66 flows through the passage 70 and discharges into the secondary combustion zone 37. In so doing, the air flows over the liquid fuel tubes 72 and the channels 96, thereby minimizing the heat-up of the liquid fuel spray nozzles 84.

The present invention may be embodied in other specific forms without departing from the spirit or essential attributes thereof and, accordingly, reference should be made to the appended claims, rather than to the foregoing specification, as indicating the scope of the invention.

We claim:

1. A gas turbine comprising:

a compressor section for producing compressed air;

a combustor for heating said compressed air, said combustor having:

a combustion zone;

first and second concentrically arranged cylindrical liners encircling at least a portion of said combustion zone, said first liner enclosing said second liner and forming an annular passage therebetween having a passage outlet leading to said combustion zone and a passage inlet in flow communication with said compressor section;

first fuel introducing means for introducing a gaseous fuel into said annular passage whereby said gaseous fuel mixes with said compressed air and enters said combustion zone through said passage outlet; and second fuel introducing means for introducing a liquid fuel into said annular passage whereby said liquid fuel mixes with said compressed air and enters said combustion zone through said passage outlet.

2. The gas turbine according to claim 1, wherein said second fuel introducing means comprises:

a) means for discharging said liquid fuel in a spray; and b) means for expanding said liquid fuel spray prior to said introduction of said liquid fuel into said annular passage.

3. The gas turbine according to claim 2, wherein said spray expanding means comprises a channel having a first portion in which said means for discharging said liquid fuel in a spray is disposed and a second portion connected to said annular passage.

4. The gas turbine according to claim 3, wherein said channel expands from said first portion to said second portion.

5. The gas turbine according to claim 4, wherein said expansion in said channel from said first portion to said second portion occurs in two directions.

6. The gas turbine according to claim 3, wherein said channel is fan shaped.

7. The gas turbine according to claim 6, wherein said fan shaped channel has an apex forming said first portion.

8. The gas turbine according to claim 3, wherein said annular passage defines a center line thereof, and wherein said channel has means for directing said expanded liquid fuel spray into said annular passage at an angle to said center line.

9. The gas turbine according to claim 2, wherein said liquid fuel discharge spray means comprises means for discharging said liquid fuel in a substantially flat spray.

10. The gas turbine according to claim 1, wherein:

a) said combustor has a third liner enclosing at least a portion of said combustion zone, said second liner enclosing said third liner; and b) said second fuel introducing means has a portion thereof disposed between said second and third liners.

11. The gas turbine according to claim 10, wherein said combustor further comprises means for directing cooling air to said second fuel introducing means.

12. The gas turbine according to claim 11, wherein:

a) said second and third liners form a second annular passage therebetween; and b) said means for directing cooling air to said second fuel introducing means comprises means for placing said second annular passage in flow communication with said compressor section, whereby a portion of said compressed air from said compressor section is directed to said second fuel introducing means.

13. The gas turbine according to claim 1, wherein:

a) said portion of said combustion zone encircled by said first and second liners forms a primary combustion zone;

b) said combustion zone has another portion forming a secondary combustion zone;

c) said passage outlet leads into said secondary combustion zone; and d) said combustor further comprises third fuel introducing means for introducing a liquid fuel into said primary combustion zone.

14. A gas turbine comprising:

a compressor section for producing compressed air;

a combustor for heating said compressed air, said combustor having:

a primary and secondary combustion zones;

first and second concentrically arranged cylindrical liners encircling at least a portion of said combustion zones, said first liner enclosing said second liner and forming an annular passage therebetween having a passage outlet leading to said secondary combustion zone and a passage inlet in flow communication with said compressor section;

first fuel introducing means for introducing a gaseous fuel into said annular passage whereby said gaseous fuel mixes with said compressed air and enters said secondary combustion zone through said passage outlet;

second fuel introducing means for introducing a liquid fuel into said annular passage whereby said liquid fuel mixes with said compressed air and enters said secondary combustion zone through said passage outlet;

third fuel introducing means for introducing a flow of fuel into said primary combustion zone; and wherein said first fuel introducing means includes means for atomizing said liquid fuel before said liquid fuel mixes with said compressed air.

15. The gas turbine according to claim 14, wherein said means for atomizing said liquid fuel comprises means for discharging said liquid fuel into said annular passage in a spray, and wherein said annular passage has means for expanding said fuel spray.

* * * * *